US009383137B2

(12) United States Patent
Schreiber et al.

(10) Patent No.: US 9,383,137 B2
(45) Date of Patent: Jul. 5, 2016

(54) DRYER

(71) Applicants: Justin M. Schreiber, Raleigh, NC (US); Steve Blackowiak, Clayton, NC (US); Shannon Ford, Sanford, NC (US)

(72) Inventors: Justin M. Schreiber, Raleigh, NC (US); Steve Blackowiak, Clayton, NC (US); Shannon Ford, Sanford, NC (US)

(73) Assignee: Buhler Aeroglide Corporation, Cary, NC (US)

( * ) Notice: Subject to any disclaimer, the term of this patent is extended or adjusted under 35 U.S.C. 154(b) by 407 days.

(21) Appl. No.: 13/963,177

(22) Filed: Aug. 9, 2013

(65) Prior Publication Data

US 2015/0040418 A1 Feb. 12, 2015

(51) Int. Cl.

| | |
|---|---|
| ***F26B 19/00*** | (2006.01) |
| ***F26B 25/08*** | (2006.01) |
| ***F26B 25/12*** | (2006.01) |
| ***E05C 9/08*** | (2006.01) |
| ***E05C 9/22*** | (2006.01) |

(52) U.S. Cl.

CPC . *F26B 25/08* (2013.01); *E05C 9/08* (2013.01); *E05C 9/22* (2013.01); *F26B 25/12* (2013.01)

(58) Field of Classification Search

CPC ..... E05B 83/10; F26B 25/009

USPC ..... 34/218, 87, 201; 192/114 R, 138, 139, 192/129 R; 292/290, 296, 194, 219, 228, 292/230, 231, 238, 198, 202–204, 210, 304, 292/DIG. 69, DIG. 29, DIG. 32, 336.3; 81/176.2, 176.1, 119, 436, 439, 461; 70/5, 187, 196

See application file for complete search history.

(56) References Cited

U.S. PATENT DOCUMENTS

| | | | | |
|---|---|---|---|---|
| 2,452,109 A | | 10/1948 | Dath | |
| 2,830,480 A | * | 4/1958 | Brame | B25B 13/02 81/176.15 |
| 3,989,289 A | * | 11/1976 | Ringe | E05B 3/10 292/218 |
| 5,396,716 A | * | 3/1995 | Smart | F26B 13/101 34/464 |
| 5,992,101 A | | 11/1999 | Potter | |

FOREIGN PATENT DOCUMENTS

CA 2325318 A1 5/2002

* cited by examiner

*Primary Examiner* — Kenneth Rinehart

*Assistant Examiner* — John McCormack

(74) *Attorney, Agent, or Firm* — Coats and Bennett PLLC

(57) ABSTRACT

A dryer for drying product includes a housing and a drying chamber formed in the housing. A series of doors are moveably mounted on the dryer for providing access to the drying chamber. A latch assembly is associated with each door for latching the door to the dryer. The latch assembly includes a bracket mounted to the door and a shaft rotatively mounted adjacent a portion of the bracket. The shaft includes a latch for engaging a latching catch and securing the door in the closed position. A locking member is pivotally mounted to the bracket and moveable between a locked and an unlocked position. In the locked position, the locking member extends into a locking cavity formed in the shaft.

18 Claims, 10 Drawing Sheets

DRYER

FIELD OF THE INVENTION

The present invention relates to commercial or industrial dryers.

BACKGROUND OF THE INVENTION

Industrial and commercial dryers are used globally to dry a wide variety of products, including food products. Today, one of the most challenging tasks facing manufacturers of dryers is that of addressing sanitation issues. This is, of course, especially true for dryers that are typically used for drying food products consumed by humans and animals.

To be sure, dryers must be designed to function, and to function efficiently. That alone does not always address sanitation requirements since sanitation issues are addressed in a number of ways. First, dryers are designed and engineered to minimize sanitation problems in general. This means that components are designed in a manner that minimize the collection of dust, debris and other matter that contributes to unsanitary conditions in and on the dryer. Moreover, components should be designed such that they can be easily and thoroughly cleaned. Here there is an emphasis on clean and simple designs that generally minimize the number of parts and minimizes cracks, crevices, and the like where matter can collect.

SUMMARY OF THE INVENTION

The present invention relates to commercial and industrial dryers having a series of doors for permitting access to a drying chamber formed in the dryer. One or more of the doors includes a latch assembly that is simply, effective, easy to clean and generally reduces sanitation risks.

In one particular embodiment, the latch assembly for at least one of the doors of the dryer includes a shaft that is rotatable in or adjacent a bracket that is mounted to the door. The shaft is rotatable between locked and unlocked positions. In the locked position, a latch extending from the bracket engages a latch catch and latches the door in a locked position. To lock the door, there is provided a locking member pivotally mounted to the bracket adjacent the shaft. The locking member is moveable between locked and unlocked positions. In the locked position, the locking member projects into a locking cavity formed in the shaft and this prevents the shaft from being rotated.

In another embodiment of the present invention, the latching assembly includes a handle for actuating the shaft where the handle is readily attachable to and detachable from the shaft. Once the door has been locked, the handle is easily detached from the shaft. This tends to secure the dryer since the handle is necessary to open the door. In one embodiment, the handle includes an end portion that includes two opposed grippers that are sized, shaped and generally configured to easily slip into one or more slots formed in the surface of the shaft. Once in the slot, the grippers can be manipulated to assume a gripping position. Once in the gripping position, the handle can be moved, causing the shaft to turn between locked and unlocked positions.

Other objects and advantages of the present invention will become apparent and obvious from a study of the following description and the accompanying drawings which are merely illustrative of such invention.

DESCRIPTION OF EXEMPLARY EMBODIMENTS

Figure 1:
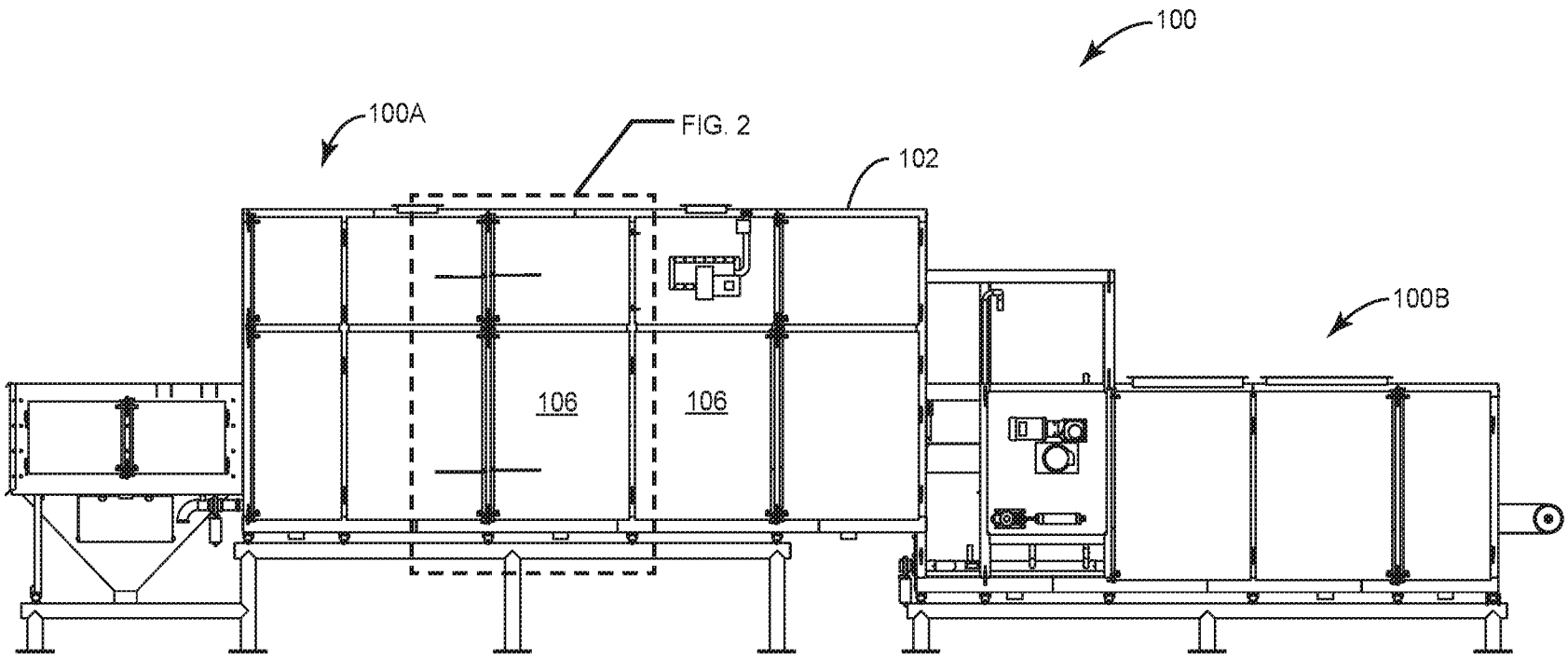
FIG. 1 is a side elevational view of a drying system including a dryer.

With further reference to the drawings, the dryer of the present invention is shown therein. In FIG. 1, a drying system, indicated generally by the numeral 100, is shown. Drying system 100 includes a dryer or drying section, indicated generally by the numeral 100A, and a cooler or cooling section 100B. Dryer 100A is a commercial or industrial dryer that is utilized to dry a wide variety of products, particularly food products such as cereals, grains, fruits and vegetables, as well as animal feed. Details of the dryer 100A are not dealt with herein because such is not per se material to the present invention and because dryers of the type shown in FIGS. 1 and 1A and discussed herein are well known and appreciated by those skilled in the art.

Figure 1A:
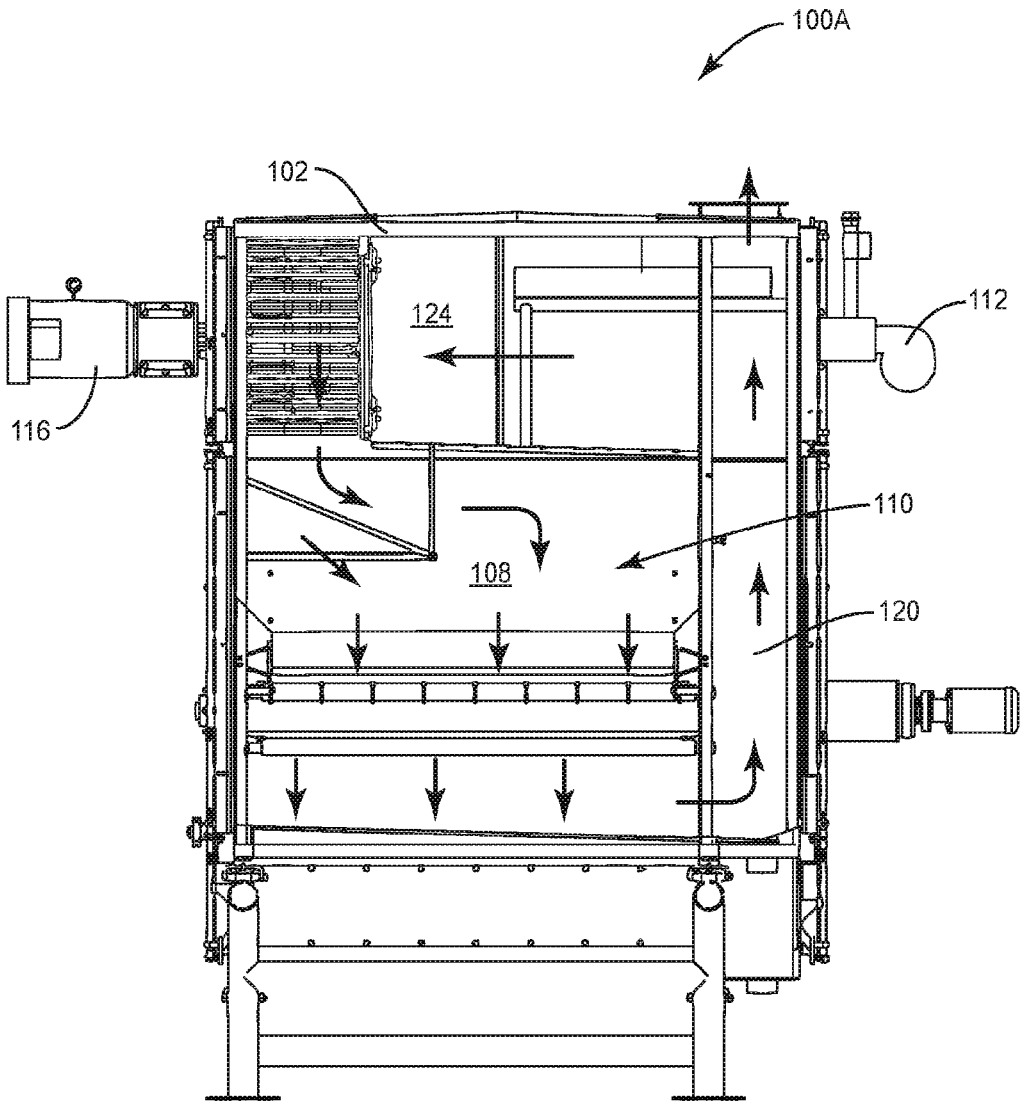
FIG. 1A is a cross-sectional view of the dryer.
Figure 2:
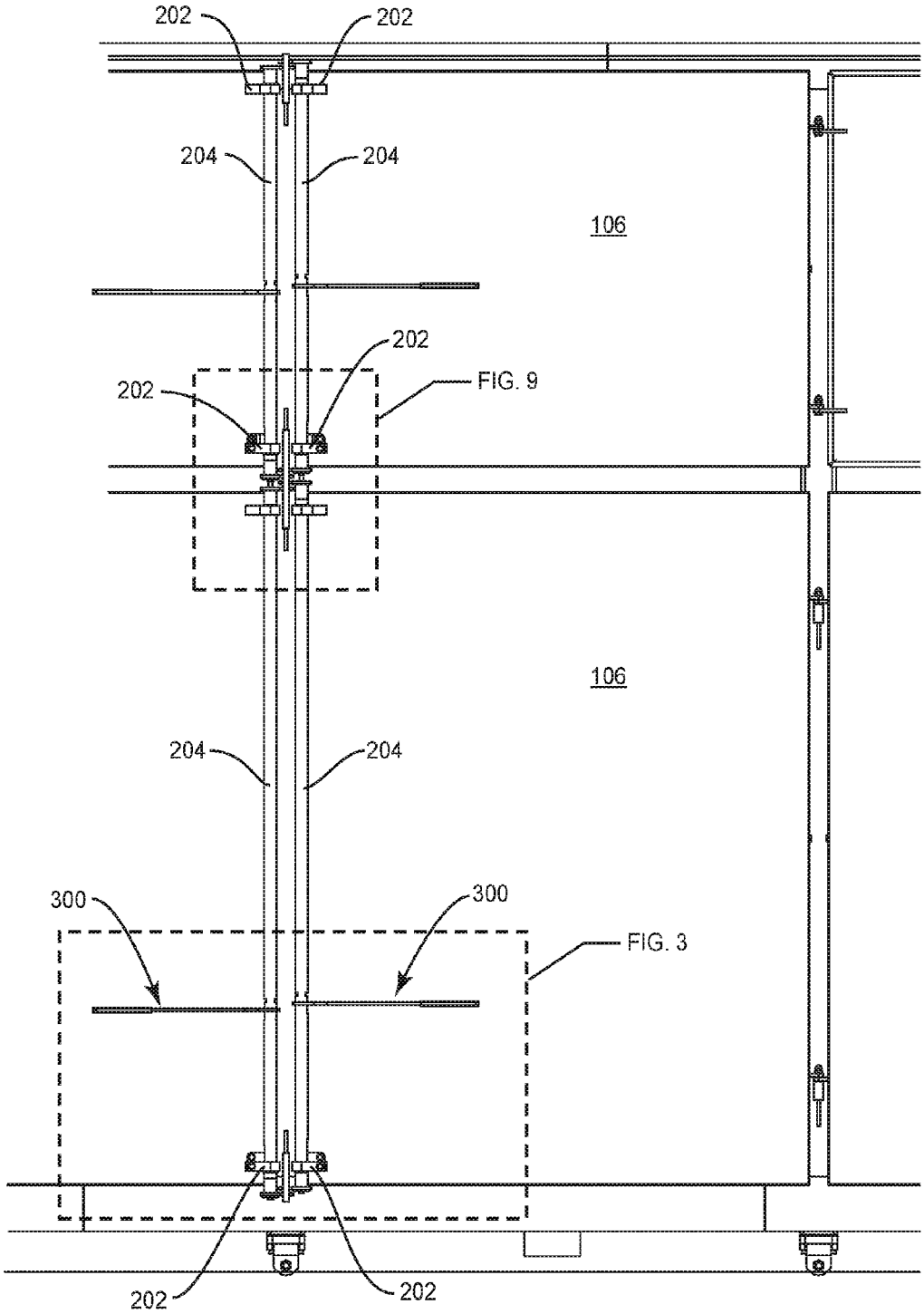
FIG. 2 is an enlarged view of the area referred to in FIG. 1.
Figure 3:
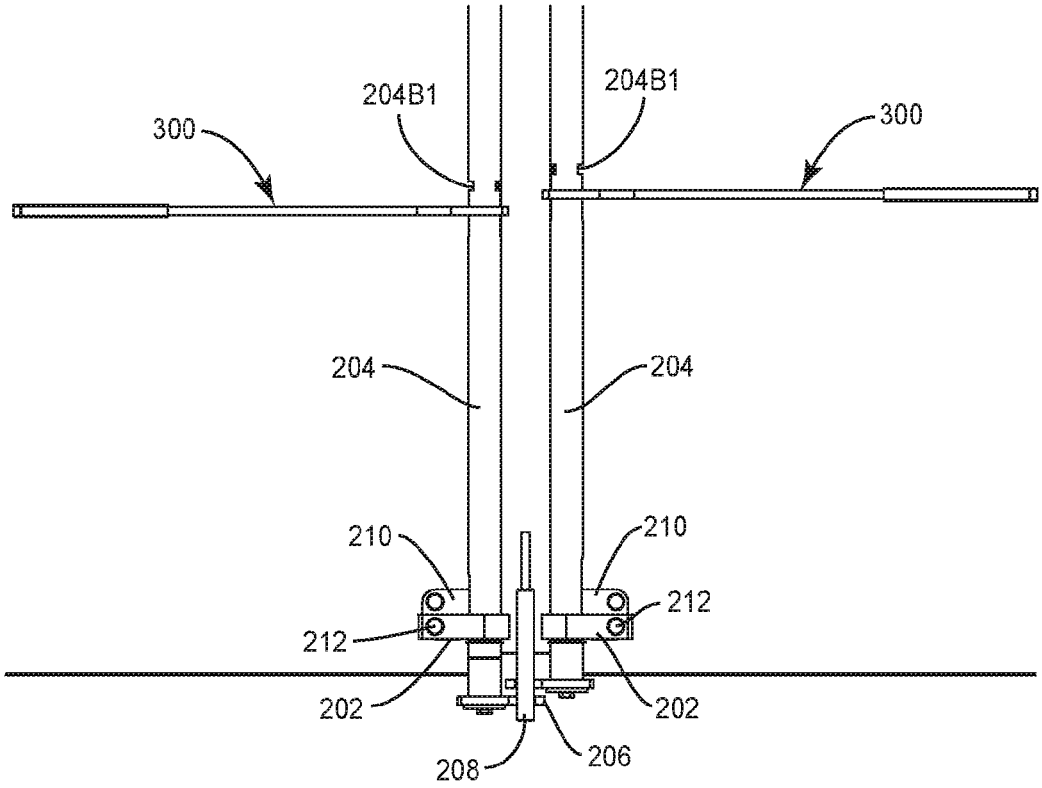
FIG. 3 is a fragmentary side elevational view showing a portion of the latch assembly associated with two doors on the dryer.

This disclosure focuses on a latch assembly for latching doors of the dryer in a closed position. However, before proceeding with a discussion concerning the latch assembly, a brief discussion of the dryer shown in FIGS. 1 and 1A is in order. Dryer 100A, in this example, comprises a housing structure that includes a roof 102 and a floor structure. See FIG. 1A. Further, the housing of the dryer includes a series of doors indicated by the numeral 106 and hinged to the dryer. As seen in the drawings, there are upper doors and lower doors. Opposed ends of the dryer 100A are generally closed.

Formed internally within the dryer 100A is a drying or conditioning chamber 108. Drying or conditioning chamber 108 includes a conveyor assembly 110 which is operative to move product through the drying chamber 108 during the drying process. Dryer 100A also includes a system for generating and circulating a system of heated or conditioned air through the dryer. In this regard, disposed about an upper side portion of the dryer 100A is a burner unit 112. Disposed adjacent the burner unit 112 is a filtered air inlet. Disposed across from the burner unit 112 is an air circulating fan assembly 116. As illustrated in FIG. 1A, the burner unit 112 generates heat and heats a system of air that moves across the burner unit and through an upper plenum 124 of the dryer. As shown in FIG. 1A, heated air moves downwardly through the drying chamber 108. Once in the drying chamber 108, the heated air moves downwardly through the conveyor assembly 110 and at the bottom of the dryer the heated air turns to the right and, as viewed in FIG. 1A, moves into a right plenum 120. From the right plenum 120, air moves upwardly and a portion of the air circulated through the dryer 100A is exhausted. Another portion of the air is recirculated through the dryer 100A in conventional fashion.

People skilled in the art understand that various flow patterns can be formed in dryers of the type shown in FIGS. 1 and 1A. More particularly, the dryer 100A in some embodiments is designed to include a number of interchangeable panels that permit air flow to be directed in various directions through the drying chamber 108. Thus, the air pattern through the drying chamber 108 can be varied or reversed by simply rearranging panels within the dryer 100A. For example, in some cases, the heated air can be directed to a lower portion of the dryer and then upwardly through the conveyor assembly 110. For a more complete and unified understanding of the basic structure, function and operation of conventional dryers of this type, one is referred to dryers manufactured and sold by Buhler Aeroglide Corporation, headquartered in Cary, N.C., U.S.A.

With further reference to the drawings, the drawings depict and show a series of latch assemblies for latching the doors 106 in a closed and locked position. In one embodiment, a latch assembly includes a pair of brackets mounted to a dryer door and a shaft rotatively mounted in the bracket or adjacent a portion of the bracket. A latch extends from the shaft for engaging a latch catch secured to the dryer so as to secure the door in a closed and locked position. The shaft and latch are rotatable between locked and unlocked positions. A locking cavity is formed in the shaft. A locking member is mounted to the bracket and moveable between a locked and an unlocked position. In the locked position, the locking member extends into a locking cavity formed in the shaft and maintains the shaft in the locked position which in turn maintains the dryer door in the closed and locked position. When in the unlocked position, the locking member is disengaged from the locking cavity in the shaft, permitting the shaft to be rotated from the locked position to the unlocked position. When the shaft and latch are rotated into a locked position, the latch engages a latch catch secured on the dryer.

Figure 6:
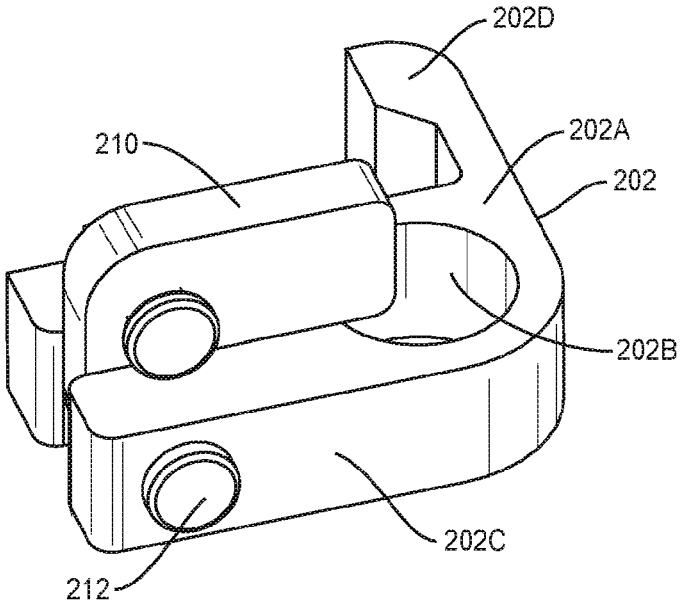
FIG. 6 is a plan view of a bracket and locking member that forms a part of the door latch assembly.
Figure 7A:
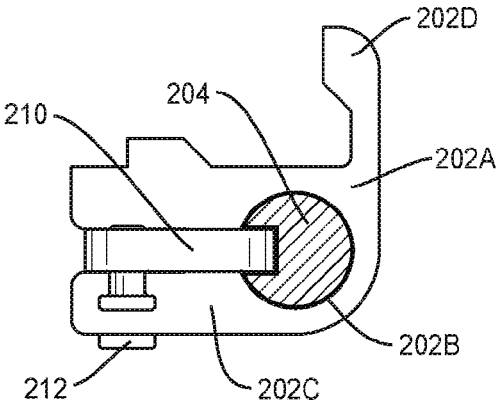
FIG. 7A is a top elevational view showing an elongated shaft extending through the bracket and locked in position.
Figure 7B:
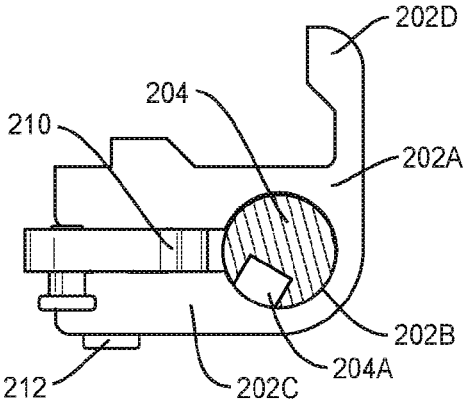
FIG. 7B is a view similar to FIG. 7A but showing the shaft in an unlocked position.

Turning more particularly to the drawings and various embodiments, the latch assembly includes a bracket 202. In this embodiment, each door is provided with two brackets 202, an upper bracket and a lower bracket. See FIGS. 6-8B. Each bracket 202 includes a main body portion 202A, and opening 202B and a support arm or finger 202D. Bracket 202 is secured to a dryer door 106. In particular, the bracket 202 extends through a front panel of the door and is connected by weldment or other suitable means to an internal frame structure within the door. As noted above, each door is provided with an upper bracket and lower bracket. The bracket just discussed is utilized as an upper bracket. The lower bracket 202 is similar to that just described except that it includes a bifurcated section 202C. See, for example, FIG. 6. As will be discussed later, the bifurcated section 202C accommodates the locking member 210.

Continuing to refer to the latch assembly, an elongated shaft 204 forms a part of the latch assembly. Shaft 204 is rotatively contained within the openings 202B of the upper and lower brackets 202. That is, the shaft 204 is rotatable within openings 202B. There is provided means for retaining the shaft 204 within the openings 202B of the upper and lower brackets. In the case of one embodiment, C-clips 205 are secured in rings or recesses formed in the shaft 204. See FIG. 9, for example. In this case, note with respect to the upper doors that there is provided two C-clips 205 inserted onto the shafts 204 just below the brackets 202. This prevents the shafts 204 from being moved upwardly with respect to the brackets 202. Continuing to refer to FIG. 9, the shafts 204 are prevented from moving downwardly by a pair of C-clips 205 that are attached to the shafts 204 just above the upper brackets 202. That is, the upper brackets 202 engage the clips 205 and prevent the shafts 204 from sliding downwardly through the brackets 202.

Figure 5A:
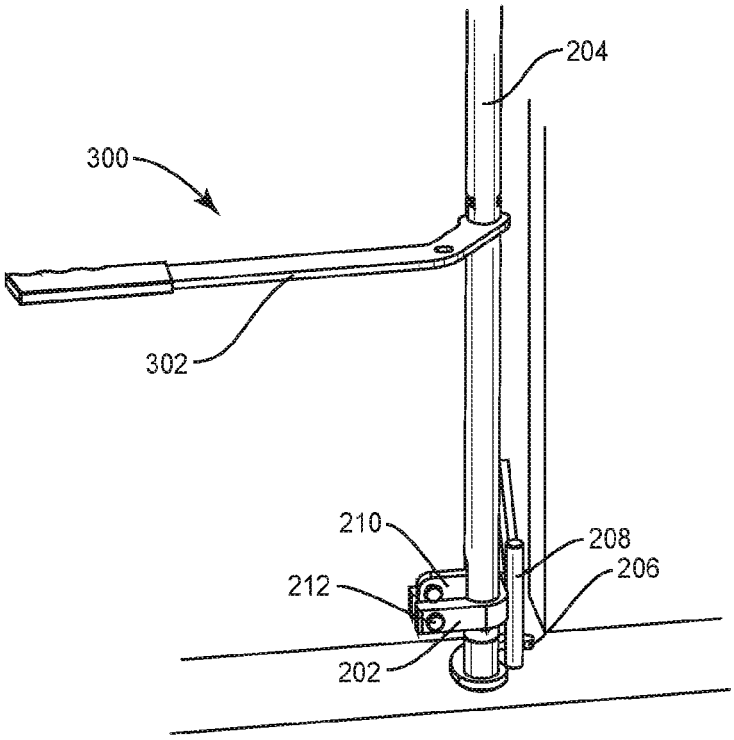
FIG. 5A is a perspective view showing a portion of the latch assembly disposed in the locked configuration.
Figure 5B:
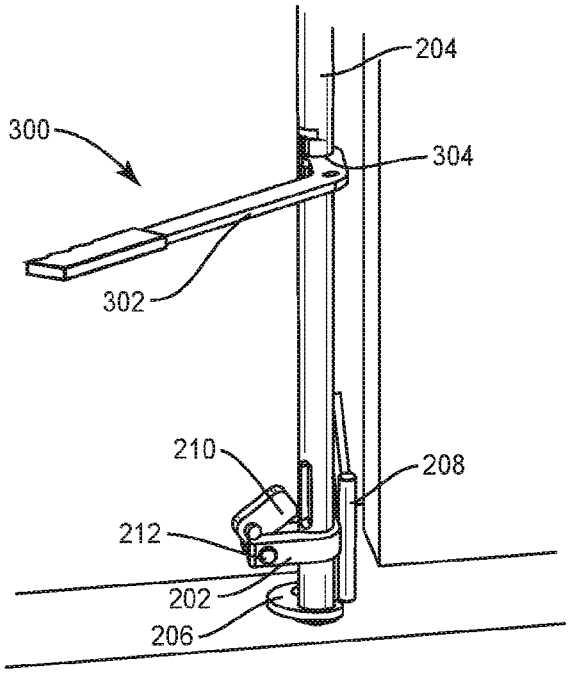
FIG. 5B is similar to FIG. 5A but showing the latch assembly being moved to the unlocked position.
Figure 9:
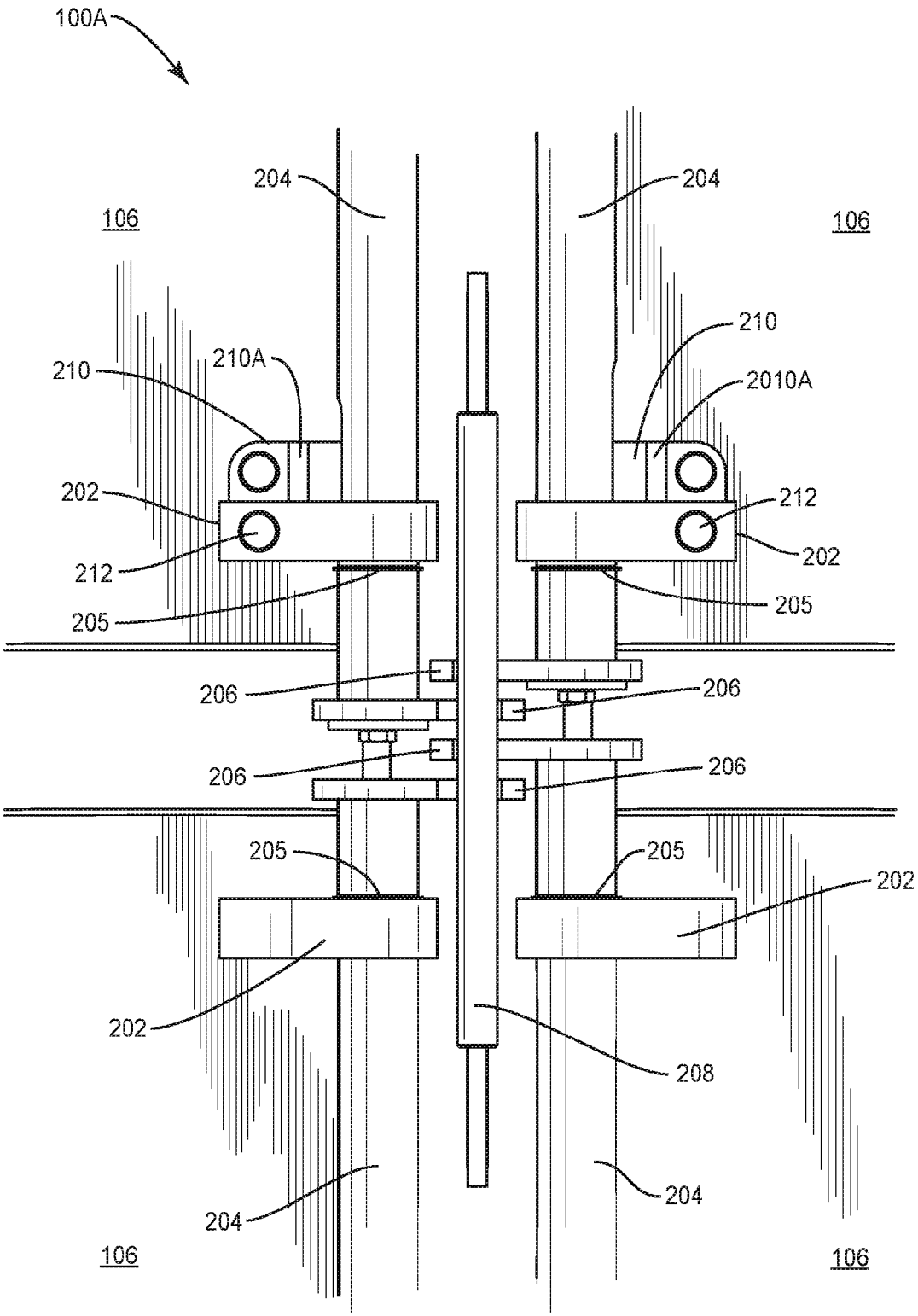
FIG. 9 is a fragmentary elevational view showing portions of a series of door latch assemblies.

At the upper and lower ends of each shaft 204, there is provided a latch 206. The latch 206 in this embodiment is in the form of a generally hook shape and is designed to engage a catch 208 that is secured to the dryer 100A and projects outwardly therefrom adjacent the various latch assemblies. It is seen and appreciated from the drawings that the shafts 204 are rotatable back and forth between locked and unlocked positions. In FIG. 9, for example, the curve shaped hooks or latches 206 are engaged with the catch 208 and are effective to lock respective doors 106 to the dryer. See also FIG. 5A that shows the curve shaped latch 206 in the latched or locked position. FIG. 5B shows the latch 206 rotated away from the locked position.

Figure 8A:
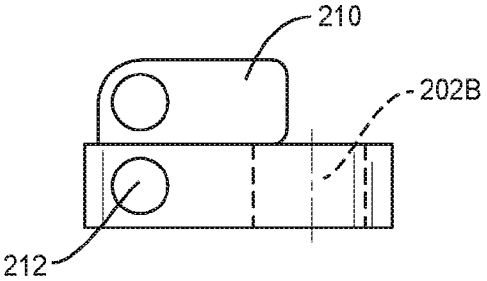
FIG. 8A is a side elevational view showing the bracket and an associated locking member.
Figure 8B:
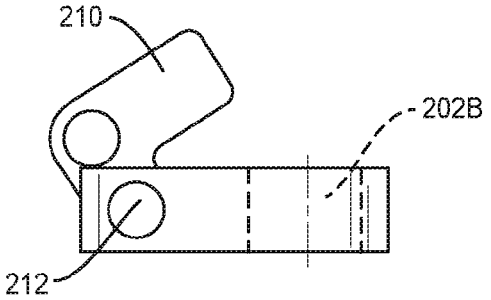
FIG. 8B is similar to FIG. 8A but showing the locking member in an inclined position.

The latch assembly described herein provides a mechanism for locking the dryer doors 106 and, in accomplishing that function, the latch assembly is designed to lock the respective shafts 204 in a locked position. This is achieved by providing a locking mechanism that is associated with the lower disposed brackets 202. With reference to FIG. 6-8B, note that there is provided a locking member 210 that is pivotally connected to the lower disposed brackets 202. Locking member 210 is disposed in a voided area between the bifurcated section 202C. See FIG. 6, for example. Locking member 210 is pivotally connected on a pivot pin 212 that extends through the bifurcated section of 202C of the bracket 202. As seen in FIGS. 8A and 8B, the locking member 210 is rotatable from a generally horizontal position (FIG. 8A) counterclockwise to an inclined position (FIG. 8B). In order to lock the shaft 204, the shaft 204 is provided with a locking cavity 204A formed therein. See locking cavity 204A shown in FIG. 7B. Locking cavity 204A is designed to receive the outer terminal end of the locking member 210 when the locking member assumes the horizontal locked position shown in FIG. 7A. That is, in the locked position, the locking member 210 projects into the locking cavity 204A and since the bracket 202 is stationery, this prevents the shaft 204 from rotating in the opening 202B of the bracket 202.

In FIG. 9, there is shown an example of how a series of latch assemblies can be employed on the dryer 100A. Shown therein is the lower portion of an upper set of doors 106 and the upper portion of a lower set of doors 106. Note that one catch 208 is utilized for all four latches 206 shown in FIG. 9. Note the slight differences in the upper and lower disposed brackets 202. Brackets 202, disposed about the lower portions of the doors, include the locking member 210. The locking cavity 204A is formed in the shaft 204 adjacent the lower brackets. Brackets 202 disposed about the upper portion of the doors do not, in this embodiment, include the locking member 210.

As illustrated in the drawings, the latch assembly discussed herein includes a detachable handle 300. Handle 300 is designed to be readily detachable to the shaft 204 in order to turn and rotate the shaft 204 between locked and unlocked positions. The term detachably connectable or securable to the shaft 204 means that the handle 300 is not permanently fixed to the shaft or is not secured to the shaft by conventional securement means such as bolts, screws, rivets, weldment, etc. Being detachably secured means that the handle can be slipped onto and off of the shaft quickly and easily without having to unfasten any securement devices.

Figure 4:
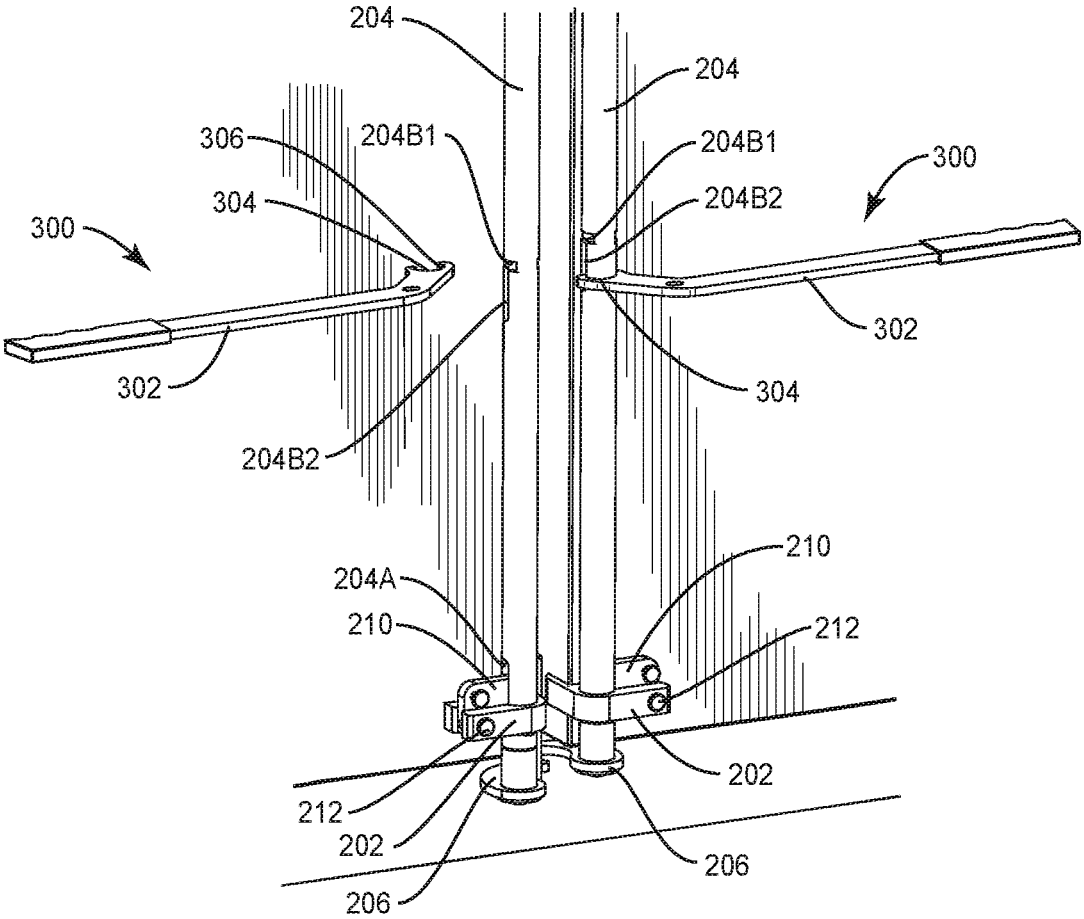
FIG. 4 is a fragmentary perspective view showing portions of the latch assembly located about the lower portion of two doors on the dryer.
Figure 11A:
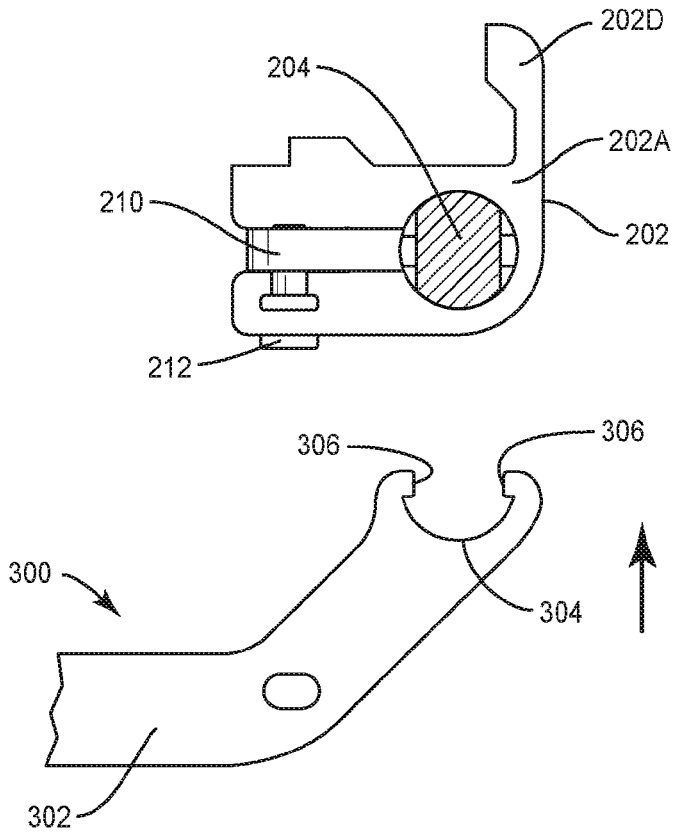
FIG. 11A is a partial sectional view illustrating the handle being inserted into slots formed in the shaft of the latch assembly.
Figure 11B:
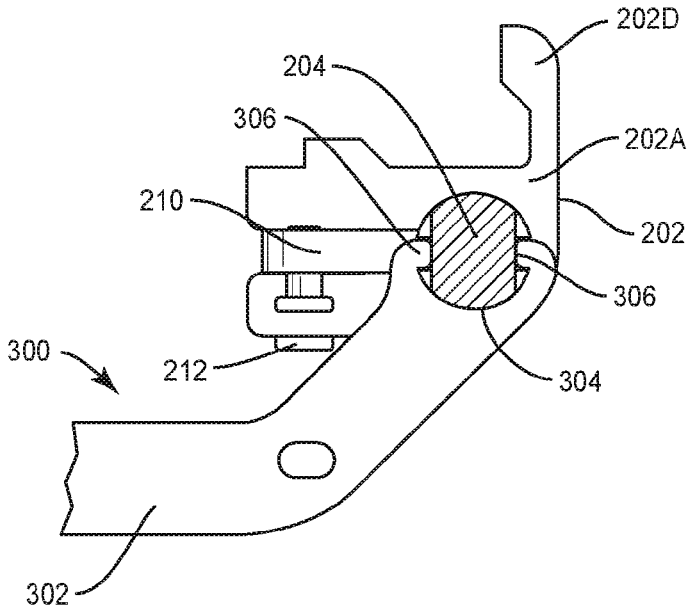
FIG. 11B is similar to FIG. 11A except that the handle is actually engaged with the shaft of the latch assembly.

With reference to FIGS. 11A and 11B, the handle 300 is shown therein and includes a main section or main body 302. Formed about a terminal end portion of the handle 300 is a jaw 304 that includes a pair of opposed grippers 306. As seen in the drawings, the grippers 306 are designed to slip onto the shaft 204 and to grip the shaft such that it can be turned. To accommodate the handle 300, the shaft 204 is provided with a slot structure for receiving the grippers 306 of the handle. In the case of the embodiments shown herein, the shaft includes two slots, with each slot being referred to by the numeral 204B. It is appreciated that a single slot structure could be provided. In the case of the slot structure described herein, the slot includes a horizontal segment 204B1. See FIG. 4. Extending from the horizontal segment 204B1 is a vertical segment 204B2. The design of the handle 300 is such that the grippers 306 are sized, spaced and shaped such that they can slide horizontally through the horizontal section 204B1 until the grippers reach the vertical segment 204B2. Once reaching the vertical segment 204B2, the grippers 306 are moved downwardly into the vertical segments where the grippers can now grip and rotate the shaft 204. Note in FIG. 11A where the distance between the inside surfaces of the grippers 306 in essentially the same as the distance between the internal side of the horizontal segment 204B1. In similar fashion, the width of the grippers 306 is designed to fit in the vertical segments 204B2.

It follows that after the handle 300 has been used to rotate the shaft 204 that the handle can be easily removed from the shaft. In the case of the embodiment illustrated in FIGS. 11A and 11B, the grippers 306 can be moved upwardly in the vertical segments 204B2 until the grippers reach the horizontal segment 204B1, after which the grippers can simply be pulled horizontally from the shaft 204.

Thus, in one embodiment, the present invention entails a handle detachably securable to the shaft such that the handle can be readily attached to and detached from the elongated shaft that forms a part of the latch assembly. The shaft includes a surface and at least one slot formed in the surface of the shaft for receiving a portion of the handle. The handle is configured to be inserted into the slot formed in the surface of the shaft such that, when inserted, the handle grips the shaft and the shaft can be rotated between the locked and unlocked positions by the handle. In one particular embodiment, the slot includes a horizontal segment and one or more vertical segments. In this embodiment, the terminal end portion of the handle is inserted into the horizontal segment and thereafter vertically into the vertical segment where the handle can grip the shaft such that the shaft can be turned back and forth between the locked and unlocked positions.

It is appreciated that when locking one of the dryer doors 106, that by rotating the shaft 204 sufficient for the hook shaped latches 206 to engage the latch catches 208 that a resilient or deformable seal structure provided around the innerface between the door and the dryer is compressed. Once the latches 206 are properly engaged with the catches 208, the seal structure will provide a locking force on the latches 206, causing them to be securely engaged and locked with the catches 208. It follows that to unlock the doors sufficient force must be applied to the shafts 204 to overcome the locking pressure being exerted by the door seal structure.

Figure 10:
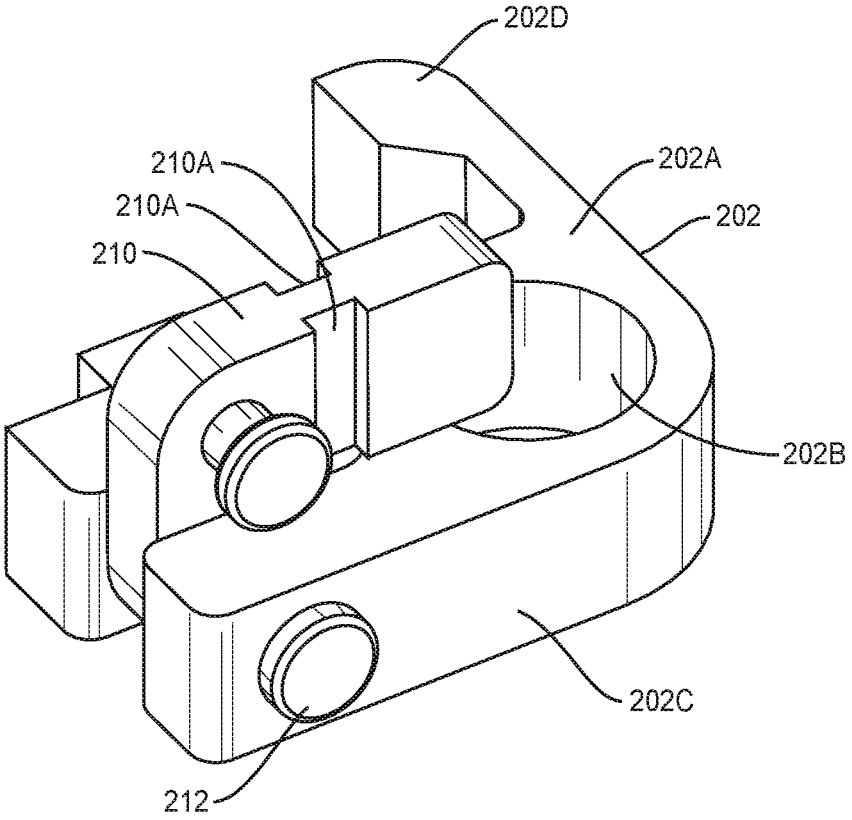
FIG. 10 is a perspective view of an alternative embodiment for the locking member where the locking member is provided with relief areas formed therein.

The upper doors 106 of the dryer 100A are designed to open in response to an explosion in the drying chamber 108. Various approaches can be incorporated to enable the upper doors 106 to effectively automatically open in response to an explosion. In an alternative embodiment, the latch assemblies disclosed herein and used in connection with the upper doors 106 can be utilized to permit the upper doors to open in response to an explosion. See FIG. 10. To achieve this function, the locking member 210 of the latch assembly is designed to fail in response to an interior explosion. In this embodiment, the locking member 210 includes opposed side surfaces. Each side surface of the locking member is provided with a relief area 210A. These relief areas are designed into the locking member 210 to fail when a predetermined amount of force is transmitted from an upper dryer door through the shaft 204 to the locking member 210. That is, the locking member 210 will break along the lines of the relief areas 210A, enabling the associated upper door 106 to swing open.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A dryer for drying a product, comprising:
- a housing;
- a drying chamber formed in the housing of the dryer;
- a burner unit for heating air used to dry the product;
- a fan for circulating heated air through the drying chamber;
- one or more doors moveably mounted on the dryer and moveable between open and closed positions;
- at least one latch catch connected to the dryer adjacent the door;
- a bracket mounted to the door;
- a shaft rotatively mounted adjacent a portion of the bracket;
- a latch extending from the shaft for engaging the latching catch and securing the door in the closed position;
- the shaft and latch being rotatable between a locked position and an unlocked position;
- a locking cavity formed in the shaft;
- a locking member moveably mounted to the bracket and moveable between a locked position and an unlocked position;
- wherein in the locked position the locking member extends into the locking cavity formed in the shaft and maintains the shaft in the locked position which in turn maintains the door in the closed position; and
- wherein in the unlocked position the locking member is disengaged from the locking cavity in the shaft, permitting the shaft to be rotated between the locked and unlocked positions.

2. The dryer of claim 1 wherein the shaft is rotatable in the bracket.

3. The dryer of claim 1 wherein the locking member includes a relief formed therein that permits the locking member to fail in the event of an explosion in the dryer.

4. The dryer of claim 3 wherein the locking member includes two opposed surfaces and wherein the relief formed in the locking member includes two opposed channels formed in the two surfaces.

5. The dryer of claim 1 including a detachable handle configured to be readily attached to and detached from the shaft such that the handle is attachable to the shaft for opening and closing the door and wherein the handle is not attached to the shaft when the door is in the closed position and the shaft is in the locked position.

6. The dryer of claim 1 wherein the shaft includes at least one slot for receiving a portion of a detachable handle; and wherein the detachable handle is configured to be inserted into the slot such that the handle can turn the shaft between the locked and unlocked positions.

7. The dryer of claim 6 wherein the handle includes a terminal end portion that includes a jaw having at least two spaced apart grippers configured to fit into the slot formed in the shaft.

8. The dryer of claim 1 wherein:

the bracket includes a round opening for receiving the shaft and wherein the shaft is rotatable in the opening; and wherein the locking member is pivotally mounted on a pin extending through a portion of the bracket and pivotable thereabout between the locked and unlocked positions.

9. The dryer of claim 8 wherein the bracket includes a main body that includes the round opening for receiving the shaft and wherein the locking member is pivotally mounted to the main body.

10. The dryer of claim 9 wherein the main body of the bracket includes a bifurcated section and wherein the locking member is pivotally mounted on a pin that extends through a space formed by the bifurcated section.

11. The dryer of claim 1 wherein the locking member is rotatable about a pin extending through a portion of the bracket and wherein the locking member is rotatable from a generally horizontal position where the locking member extends into the locking cavity in the shaft to a position where the locking member is rotated out of engagement with the locking cavity in the shaft.

12. The dryer of claim 9 wherein the bracket further includes a support finger extending from the main body through an outer surface of the door.

13. A dryer for drying a product, comprising:

a housing;

a drying chamber formed in the housing of the dryer;

a burner unit for heating air used to dry the product;

a fan for circulating heated air through the drying chamber;

one or more doors moveably mounted on the dryer and moveable between open and closed positions;

a latching assembly for latching the door to the dryer;

the latching assembly including an elongated shaft mounted on the door and having at least one latch extending therefrom for engaging a latch catch mounted on the dryer;

the elongated shaft and latch being rotatable between locked and unlocked positions and in the locked position the latch extending from the elongated shaft engages the latch catch and locks the door in the closed position;

a handle detachably securable to the shaft such that the handle can be readily attached to and detached from the elongated shaft;

the shaft having a surface and at least one slot formed in the surface of the shaft for receiving a portion of the handle;

the handle configured to be inserted into the slot formed in the surface of the shaft such that when inserted the handle grips the shaft and the shaft can be rotated between the locked and unlocked positions by the handle;

wherein the slot includes a generally horizontal segment and a generally vertical segment that is communicatively connected with the horizontal segment; and wherein the handle is configured to be inserted into the horizontal segment and to move therein to a point where the handle then moves vertically through the vertical segment where the handle can grip and rotate the shaft; and wherein the handle is configured to move vertically through the vertical segment to a point where the handle reaches the horizontal segment at which time the handle can be moved through the horizontal segment and from the shaft.

14. The dryer of claim 13 wherein the handle includes a C-shaped jaw formed on an outer end portion of the handle; and wherein a portion of the C-shaped jaw is configured to be inserted into the slot.

15. The dryer of claim 13 wherein the handle includes two spaced apart grippers for engaging the slot formed in the surface of the shaft; and wherein the handle is engaged with the shaft by inserting the grippers into the horizontal slot and moving the grippers vertically into the vertical segment.

16. The dryer of claim 13 wherein the detachable handle comprises an elongated member having a generally C-shaped jaw formed on one end portion thereof; and wherein the jaw includes two generally opposed grippers that project inwardly towards each other and wherein the grippers are sized, shaped and disposed with respect to each other to engage the slot formed in the surface of the shaft to enable the handle to rotate the shaft between the locked and unlocked positions.

17. The dryer of claim 13 wherein the shaft includes a locking cavity formed therein; and wherein there is a bracket mounted to the door and wherein a locking member is moveably mounted to the bracket and moveable between a locked position and an unlocked position; and wherein in the locked position the locking member extends into the locking cavity formed in the shaft and maintains the shaft in the locked position, which in turn maintains the door in a closed position.

18. A dryer for drying a product, comprising:

a housing;

a drying chamber formed in the housing of the dryer;

a burner unit for heating air used to dry the product;

a fan for circulating heated air through the drying chamber;

one or more doors moveably mounted on the dryer and moveable between open and closed positions;

a latching assembly for latching the door to the dryer;

the latching assembly including an elongated shaft mounted on the door and having at least one latch extending therefrom for engaging a latch catch mounted on the dryer;

the elongated shaft and latch being rotatable between locked and unlocked positions and in the locked position the latch extending from the elongated shaft engages the latch catch and locks the door in the closed position;

a handle detachably securable to the shaft such that the handle can be readily attached to and detached from the elongated shaft;

the shaft having a surface and at least one slot formed in the surface of the shaft for receiving a portion of the handle;

the handle configured to be inserted into the slot formed in the surface of the shaft such that when inserted the handle grips the shaft and the shaft can be rotated between the locked and unlocked positions by the handle;

wherein the shaft includes a locking cavity formed therein;

wherein there is a bracket mounted to the door and wherein a locking member is moveably mounted to the bracket and moveable between a locked position and an unlocked position; and wherein in the locked position the locking member extends into the locking cavity formed in the shaft and maintains the shaft in the locked position, which in turn maintains the door in a closed position.

* * * * *